US005683002A

United States Patent [19]

Rayside

[11] Patent Number: 5,683,002

[45] Date of Patent: Nov. 4, 1997

[54] CAP AND VISOR ORGANIZER

[76] Inventor: Robert Rayside, 105 Edison Glen Terrace, Edison, N.J. 08837

[21] Appl. No.: 683,304

[22] Filed: Jul. 18, 1996

[51] Int. Cl.[6] ..... A47F 7/00

[52] U.S. Cl. ..... 211/30; 211/32; 211/113; 211/115

[58] Field of Search ..... 211/30, 32, 113, 211/115

[56] References Cited

U.S. PATENT DOCUMENTS 5,265,737 11/1993 Freeby ..... 211/30
5,344,003 9/1994 Park ..... 211/32 X
5,348,166 9/1994 Lema ..... 211/30
5,396,994 3/1995 Fitzgerald ..... 211/30 X
5,411,144 5/1995 Deupree ..... 211/30

*Primary Examiner*—Robert W. Gibson, Jr.
*Attorney, Agent, or Firm*—Jeffrey I. Kaplan, Esq.

[57] ABSTRACT

An improved hat holder is disclosed wherein a body comprises a plurality of slots based upon by a distance equal to a width of a hat brim. A plurality of hats are conveniently stored by inserting the brim into the slot, and folding down the portion of the hat that sits on top of user's head.

7 Claims, 3 Drawing Sheets

CAP AND VISOR ORGANIZER

TECHNICAL FIELD

This invention relates to clothing storage, and more particularly, to an improved technique for storing a plurality of baseball type hats, often called "caps" and visors in an organized and neat manner.

BACKGROUND OF THE INVENTION

Baseball caps and visors are utilized by many individuals who play sports, as well as to simply wear during the summer months to protect one's head and eyes from sun. These hats typically include a portion which goes around one's head ("head portion"), as well as a visor portion which extends therefrom. The shape of the visor portion is shown in FIG. 7, and includes two curvalinear borders 604 and 605 which intersect each other.

For those who have large collections of these hats, convenient storage presents a problem. The hats are typically piled on top of one another on the shelf in a closet, stored away in a drawer, or stacked on a table. The hats lose their shapes due to such incorrect storage. Often the visor or other portions of the hat may bend or become deformed. There is no known way to conveniently and neatly organize these hats and visors.

SUMMARY OF THE INVENTION

The above and other problems of the prior art are overcome in accordance with the present invention which relates to a cap and visor organizer for conveniently storing a plurality of caps, and for storing the same in a closet. In accordance with the present invention, a substantially flat storage surface includes a plurality of slots, each spaced apart by a predetermined distance, for storing the hats. The visor portion of each hat is placed into a different slot, thereby neatly aligning all of the hats along the surface of the hat holder. Preferably, the slots are arranged to match the size and shape of the visor portion of the hat.

Optionally, hats may be stored on both sides of the hat holder, or covers may be provided to protect all of the hats from dust.

DETAILED DESCRIPTION OF THE PREFERRED EMBODIMENT

Figure 1:
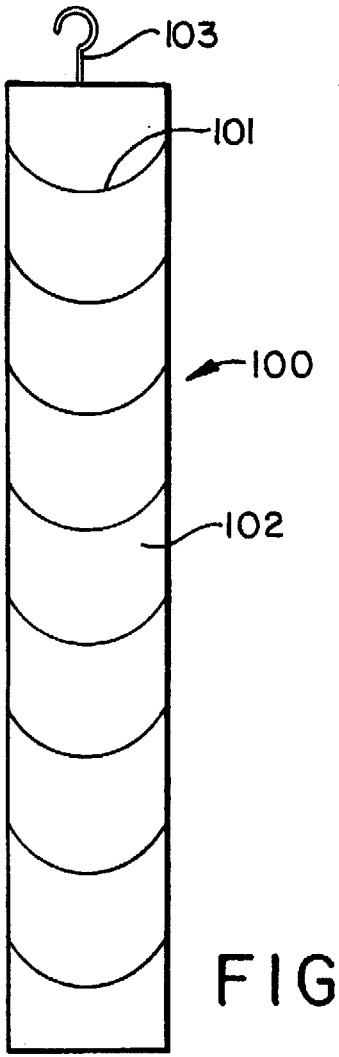
FIG. 1 depicts a front view of a hat holder in accordance with the invention.

FIG. 1 shows the inventive hat holder 100 including a plurality of slots 101, a body 102, and a hanging member

103. The body may be constructed of plastic, cardboard, vinyl, or any other suitable material. Hanging member 103 may be constructed of metal, plastic, or a variety of other materials. Additionally, the hanging member 103 may be formed as a separate member and attached to body 102, or may be integrally formed with body 102 as part of, for example, an injection molding process.

Figure 4:
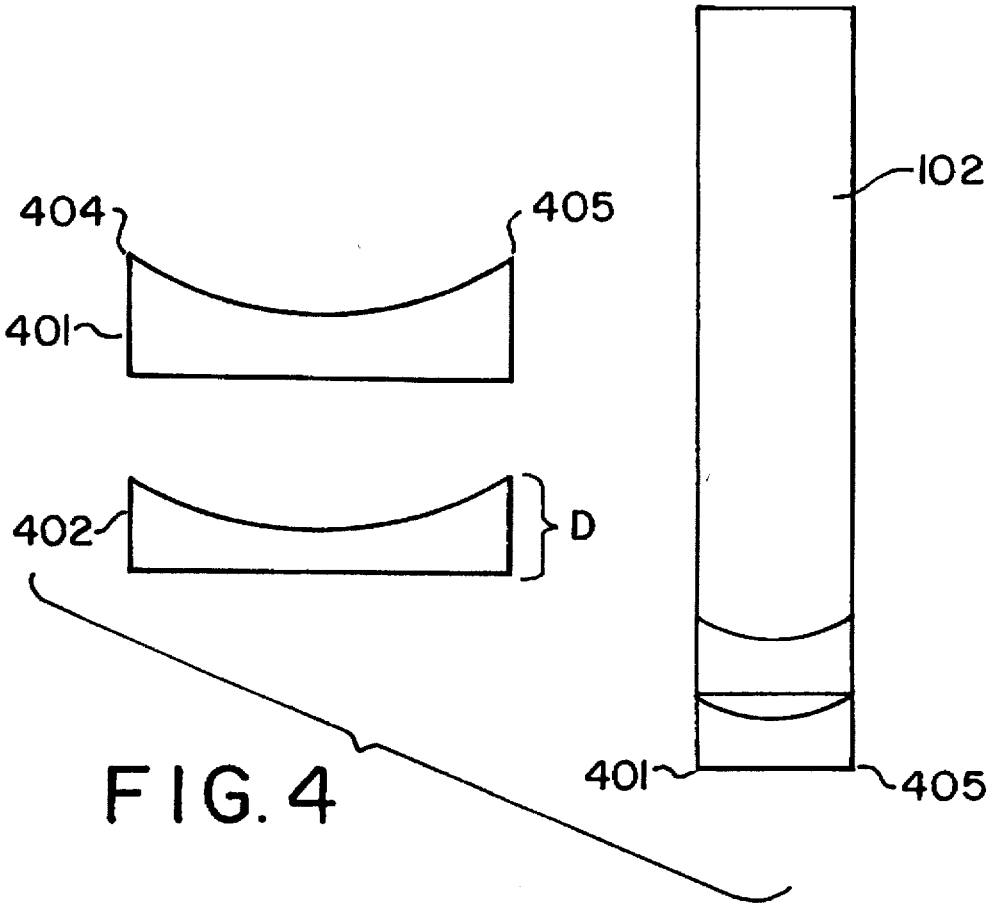
FIG. 4 shows several members 404 which may be utilized to construct the hat holder.
Figure 6:
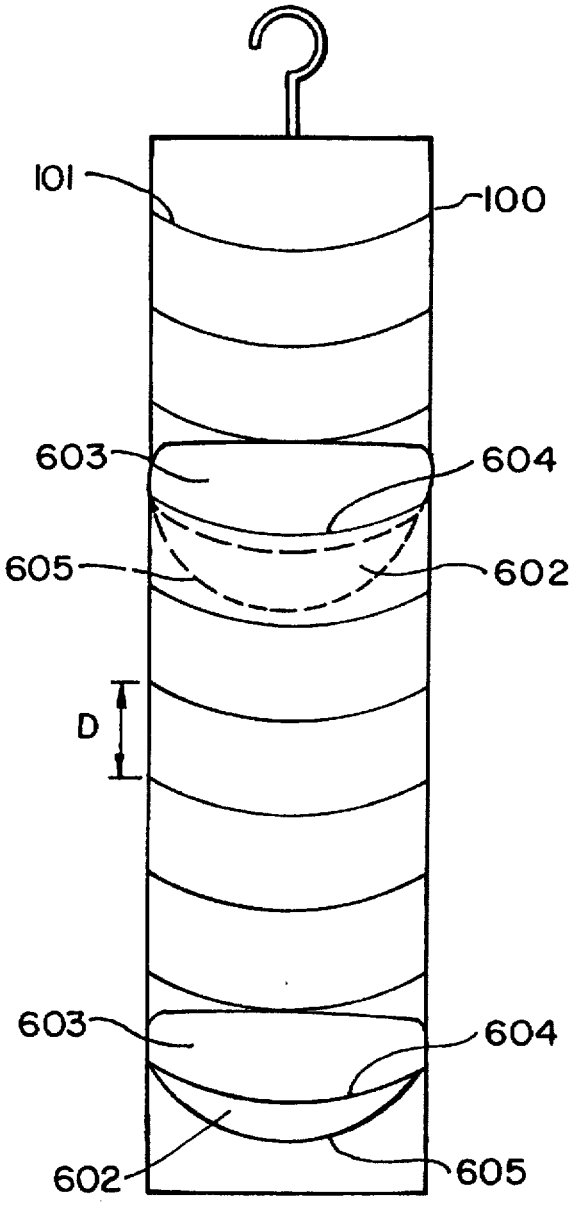
FIG. 6 shows two of a plurality of hats stored in the inventive hat holder, each hat having its head portion folded down.
Figure 7:
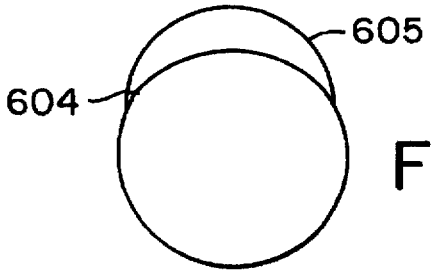
FIG. 7 depicts an example hat which may be stored in accordance with the invention.

The slots 101 may be placed upon the body 102 in a variety of manners. One technique is shown in FIG. 4. A plurality of members 401–402 are manufactured, each being of height D which corresponds approximately to the length of the visor portion of a hat to be stored in hat holder 100, as shown in FIG. 6. The holders 401 to 402, and a plurality of other such holders, are then each attached to the body 102 by any suitable fastening means along the edges 404 and 405, as shown in FIG. 4.

Figure 2:
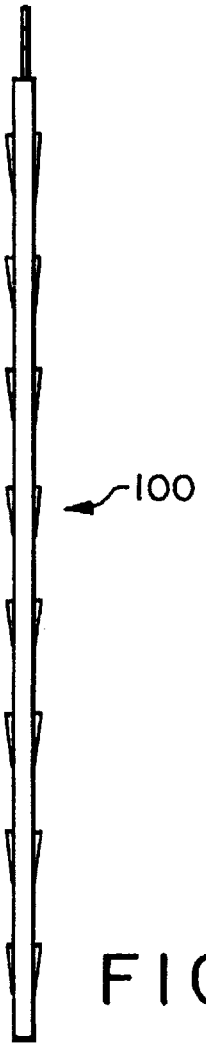
FIG. 2 depicts a side view of an exemplary embodiment of the hat holder including hat holding slots on both sides thereof.

FIG. 2 shows a side view of an exemplary embodiment of the invention wherein slots 101 are included on both sides of body 102. The utilization of both sides of body 102 provides for a larger number of hats that may be stored on hat holder 100.

Figure 3:
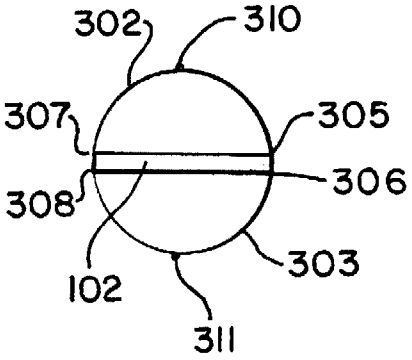
FIG. 3 depicts a bottom view of a hat holder including a plurality of protective surfaces which may be utilized in an enhanced embodiment of the present invention.
Figure 5:
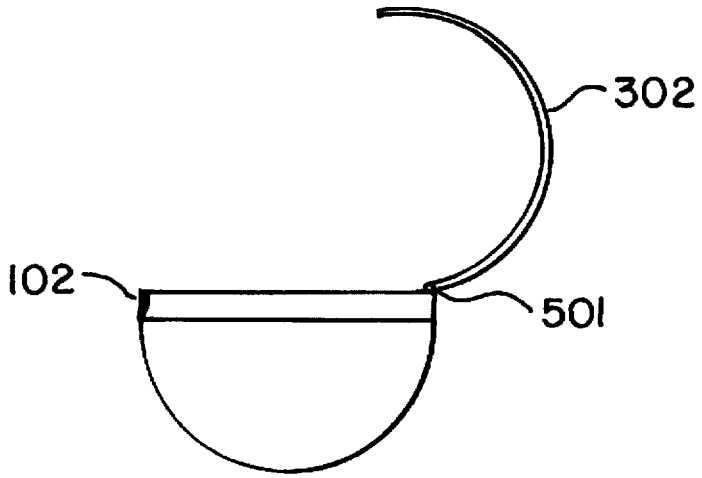
FIG. 5 shows a bottom view of an enhanced embodiment of the present invention including covers for preventing dust and debri from accumulating on the hats stored utilizing the inventive technique.

FIG. 3 shows a bottom view of an enhanced embodiment of a hat holder including body 102 and two cover members 302 to 303. The cover members may be permanently attached along edges 305 through 308, and may include zippers 310–311 for revealing the hats. Alternatively, as seen in FIG. 5, the cover members may each include a hinge 501 and may be constructed of plastic. FIG. 5 shows a hinge cover 302 open during operation thereof by a user.

The inventive apparatus provides a technique for neatly and effectively storing the hats. Each hat may be stored by inserting its visor into a slot and folding down the portion of the hat that sits on top of the user's head.

FIG. 6 depicts the inventive hat holder 100 with two exemplary hats shown installed therein. Several points are worth noting. First, the shape of the slots 101 are curvalinear and match the shape of curvalinear border 604 of the hats installed in the hat holder 100. Additionally, the separation D between successive slots 101 of the hat holder 100 is substantially the same size as the visor 602 of the hats installed therein. The distance D is slightly more than three inches, but in any event, is a quantity well known to those of ordinary skill in the art. Accordingly, by folding the head portion 603 as shown, the hats stack neatly, one against the next, for convenient storage.

It is understood that while the above describes the preferred embodiment, various other modifications and or additions will be apparent to those of ordinary in the art. For example, the distances between the slots may be varied to accommodate different size hats, and the number of slots may be varied to allow for storage of more hats.

I claim:

1. A hat holder comprising:

a central and substantially flat body having a width and edges;

a plurality of members, each member being curvalinear in shape to match a shape defined by the visor of a hat the members being spaced apart so as to substantially accommodate a plurality of hats to be stored the members being attached to the central and substantially flat body to form slots the members having a width substantially equal to the width of said body, the members having edges, the edges of the members and the edges of the body being connected to facilitate the holding of hats by the slots; and hanging means for hanging the hat holder in a closet or the like.

2. Apparatus of claim 1 further comprising cover means connected to said hat holder for enclosing the hats being stored by said apparatus.

3. Apparatus of claim 2 wherein said hat holder has two sides, each side including a plurality of slots thereon.

4. Apparatus of claim 3 manufactured from plastic.

5. Apparatus of claim 4 wherein said hanging means is manufactured from metal.

6. Apparatus of claim 1 wherein said slots are spaced apart by approximately 3¼ inches to match the size of the visor of a standard baseball cap to be stored thereon.

7. A method of forming a hat holder comprising;

forming a flat central body having edges and a length;

placing members against the body at equally spaced increments to form slots, said slots being spaced apart by an amount substantially equal to a standard sports cap; and attaching said members to said body to facilitate the formation of a slot for sandwiching a brim of a cap between said member and said central body.

* * * * *